US008813615B2

(12) United States Patent
Wason

(10) Patent No.: US 8,813,615 B2
(45) Date of Patent: Aug. 26, 2014

(54) HANDLE ASSEMBLY FOR HAND-OPERATED TOOL

(75) Inventor: Peter Matthew Wason, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 265 days.

(21) Appl. No.: 13/489,854

(22) Filed: Jun. 6, 2012

(65) Prior Publication Data

US 2013/0327191 A1 Dec. 12, 2013

(51) Int. Cl.
*B25G 1/10* (2006.01)
*B25G 1/06* (2006.01)
*G05G 11/00* (2006.01)

(52) U.S. Cl.
CPC *B25G 1/06* (2013.01); *G05G 11/00* (2013.01); *B25G 1/10* (2013.01)
USPC ..... 81/489

(58) Field of Classification Search
USPC ..... 81/489; 16/430, 445; 294/57, 58
See application file for complete search history.

(56) References Cited

U.S. PATENT DOCUMENTS

| | | | | |
|---|---|---|---|---|
| 4,179,805 | A | 12/1979 | Yamada | |
| 4,958,407 | A | 9/1990 | Johnson | |
| 5,065,475 | A | 11/1991 | Watt | |
| 5,133,101 | A | 7/1992 | Hauser et al. | |
| 5,799,996 | A | 9/1998 | Fredrickson | |
| 7,076,838 | B2 * | 7/2006 | Meixner | 16/431 |
| D580,732 | S | 11/2008 | Meagher et al. | |
| 7,571,517 | B2 | 8/2009 | Smith et al. | |
| 7,707,684 | B2 | 5/2010 | Hittmann et al. | |
| 2003/0037643 | A1 | 2/2003 | Hess | |

* cited by examiner

*Primary Examiner* — David B Thomas
(74) *Attorney, Agent, or Firm* — Mark S. Bicks; Alfred N. Goodman

(57) ABSTRACT

A handle assembly for a hand-operated tool includes first and second front vertical members pivotally connected to the tool and first and second rear vertical members pivotally connected to the tool. A first connecting link connects the first front and rear vertical members. A second connecting link connects the second front and rear vertical members. A first handle extends between the first and second front vertical members. A second handle extends between the first and second rear vertical members.

20 Claims, 7 Drawing Sheets

HANDLE ASSEMBLY FOR HAND-OPERATED TOOL

FIELD OF THE INVENTION

The present invention relates generally to a handle assembly for a hand-operated tool. More particularly, the present invention relates to a handle assembly having two vertical members pivotally connected to a hand-operated tool that remain substantially vertical during use of the tool. Still more particularly, the present invention relates to a handle assembly having two connecting links that remain substantially parallel to the tool during use. The handle assembly improves ergonomics and control of the hand-operated tool.

BACKGROUND OF THE INVENTION

Many hand-operated tools are heavy, unwieldy and difficult to control and operate. Depending on the particular application for which the tool is being used, maneuvering the tool into the appropriate position to accomplish a task and maintaining the tool in that position during use is difficult. Accordingly, a need exists for a handle assembly for a tool that improves ergonomics and control of the tool.

SUMMARY OF THE INVENTION

In accordance with an aspect of the present invention, a need exists for an improved handle assembly for a tool.

In accordance with another aspect of the present invention, the handle assembly includes first and second vertical members that remain substantially vertical during use.

In accordance with another aspect of the present invention, the handle assembly includes first and second connecting links that remain substantially parallel to a tool during use.

In accordance with another aspect of the present invention, the handle assembly includes a removable connecting link such that first and second handle are disposable on opposite sides of a tool.

The foregoing objectives are basically attained by a handle assembly for a hand-operated tool includes first and second front vertical members pivotally connected to the tool and first and second rear vertical members pivotally connected to the tool. A first connecting link connects the first front and rear vertical members. A second connecting link connects the second front and rear vertical members. A first handle extends between the first and second front vertical members. A second handle extends between the first and second rear vertical members. The handle assembly provides improved ergonomics and control for hand-operated tools.

The foregoing objectives are also basically attained by a tool including a tool body and a handle assembly connected to the tool body. The handle assembly includes first and second front vertical members pivotally connected to the tool body, and first and second rear vertical members pivotally connected to the tool body. A first connecting link connects the first front and rear vertical members. A second connecting link connects the second front and rear vertical members. A first handle extends between the first and second front vertical members. A second handle extends between the first and second rear vertical members. The handle assembly provides improved ergonomics and control for the hand-operated tool.

Objects, advantages, and salient features of the invention will become apparent from the following detailed description, which, taken in conjunction with the annexed drawings, discloses exemplary embodiments of the invention.

As used in this application, the terms "front", "rear", "upper", "lower", "upwardly", "downwardly" and other relative orientational descriptors are intended to facilitate the description of the handle assembly, and are not intended to limit the structure of the handle assembly to any particular position of orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numbers will be understood to refer to like parts, components and structures.

DETAILED DESCRIPTION OF THE EXEMPLARY EMBODIMENT

Figure 1:
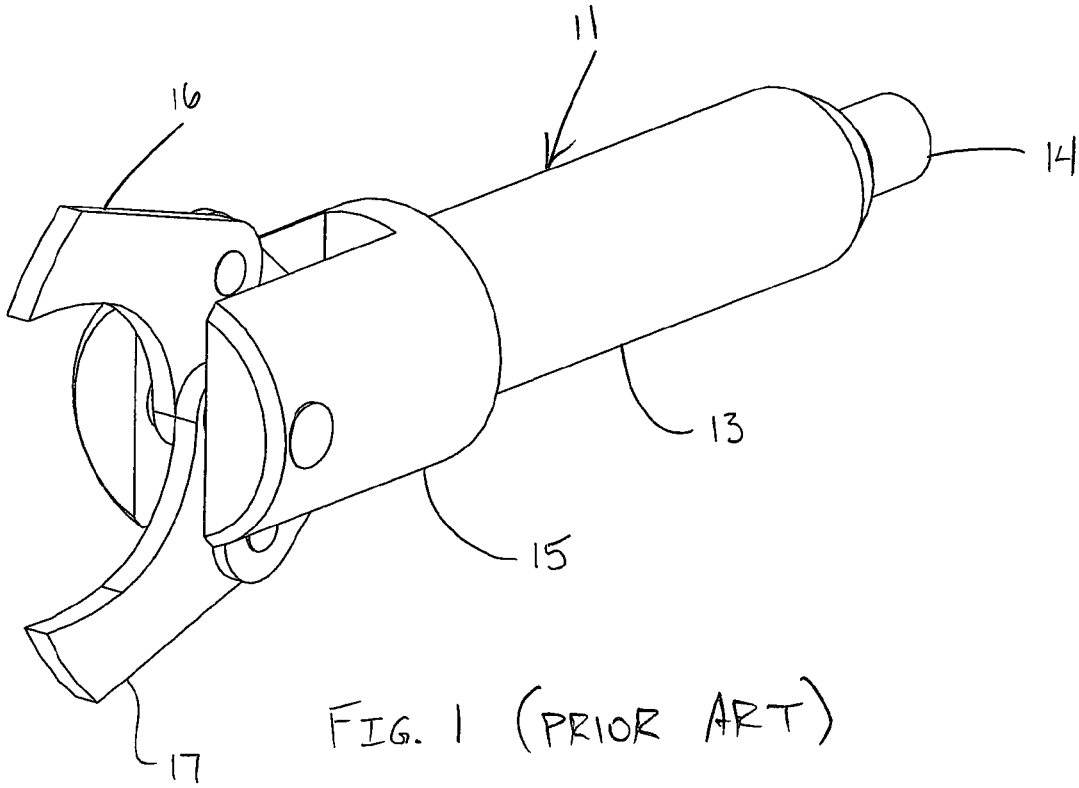
FIG. 1 (PRIOR ART)
FIG. 1 is a perspective view of an existing tool.

In an exemplary embodiment of the present invention shown in FIGS. 1-12, a handle assembly 21 for a hand-operated tool 11 improves ergonomics and control of the tool. The handle assembly 21 can be retro-fitted to an existing tool or the tool can be manufactured with the handle assembly 21 installed. The handle assembly 21 can be used with any suitable hand-operated tool 11, such as, but not limited to, a hydraulic, scissor-action cutting tool for cutting large diameter cable, as shown in FIGS. 1-8. The tool 11 has a tool body 13 having a hydraulic connection 14 at a first end of the tool body 13 and a cutter head 15 at a second end thereof. The hydraulic connection 14 supplies power to drive the cutting blades 16 and 17.

Figure 7:
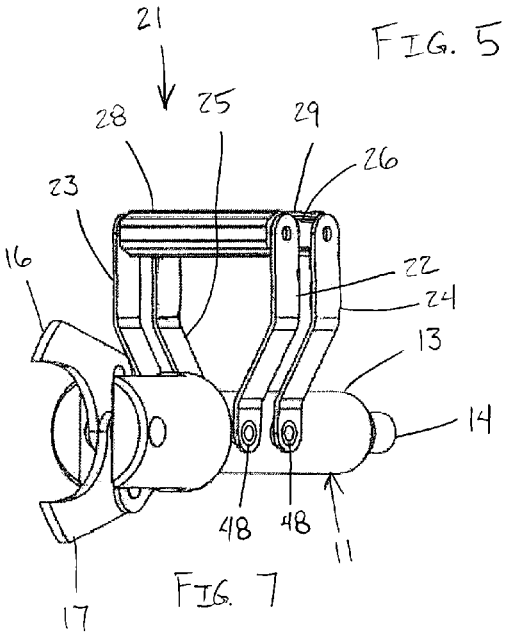
FIG. 7 is a perspective view of the tool and handle assembly of FIG. 4.
Figure 6:
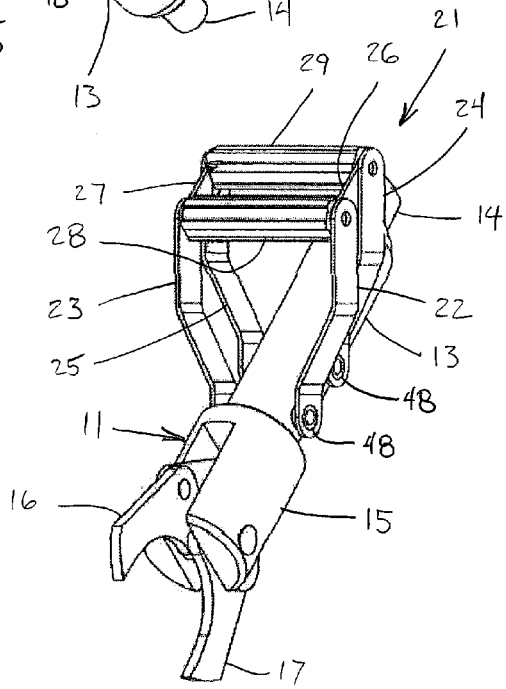
FIG. 6 is a perspective view of the tool and handle assembly of FIG. 2.

The handle assembly 21 includes first and second front vertical members 22 and 23 pivotally connected to the tool body 13, as shown in FIGS. 6 and 7. First and second rear vertical members 24 and 25 are pivotally connected to the tool body 13. A first connecting link 26 connects the first front vertical member 22 and the first rear vertical member 24. A second connecting link 27 connects the second front vertical member 23 and the second rear vertical member 25. A first handle 28 extends between the first front vertical member 22 and the second front vertical member 23. A second handle 29 extends between the first rear vertical member 24 and the second rear vertical member 25.

Figure 9:
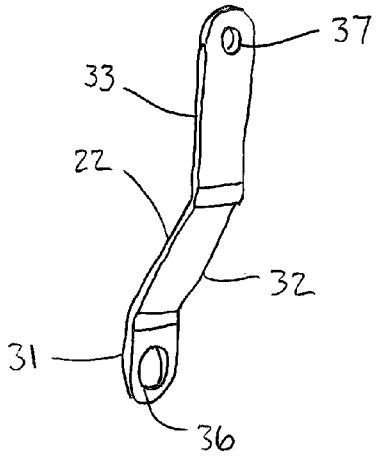
FIG. 9 is a perspective view of a vertical member of FIG. 2.
Figure 10:
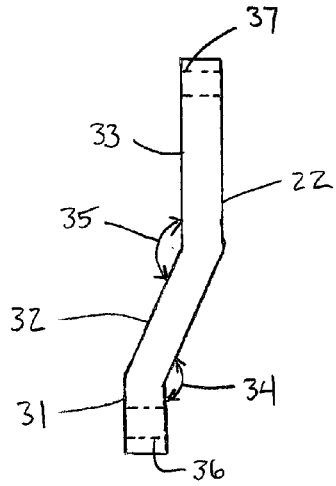
FIG. 10 is a front elevational view of the vertical member of FIG. 9.

Each of the vertical members 22-26 is substantially identical. As shown in FIGS. 9 and 10, the vertical member 22 has a first planar portion 31 and a third planar portion 33 connected by a second planar portion 32. The first and third planar portions 31 and 32 are offset from one another such that the second planar portion forms angles 34 and 35 with the first and third planar portions 31 and 33, respectively. Angles 34 and 35 can be any suitable angle that allows a user to fit his hand between the oppositely disposed third planar portions 31. Preferably, the first and third planar portions 31 and 33 are substantially parallel to one another. A first opening 36 is formed in the first planar portion 31 to receive a pin to pivotally connect the vertical member 22 to the tool body 13. A second opening 37 is formed in the second planar portion 33 to removably and rotatably receive a handle 28, as shown in FIGS. 2-8. Preferably, the vertical members 22-26 are made of a metal, such as, but not limited to, steel or aluminum.

Figure 11:
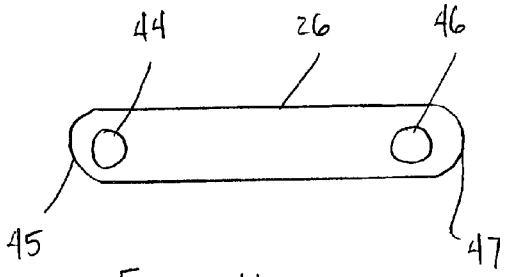
FIG. 11 is a side elevational view of a connecting link of FIG. 2.

Each of the first and second connecting links 26 and 27 is substantially identical. As shown in FIG. 11, the connecting link 26 has a first opening 44 at a first end 45 thereof. A second opening 46 is disposed at a second end 47 of the connecting link 26. Preferably, the connecting links 26 and 27 are made of a metal, such as, but not limited to, steel or aluminum, and are between vertical members 22-25 and handles 28 and 29.

Figure 12:
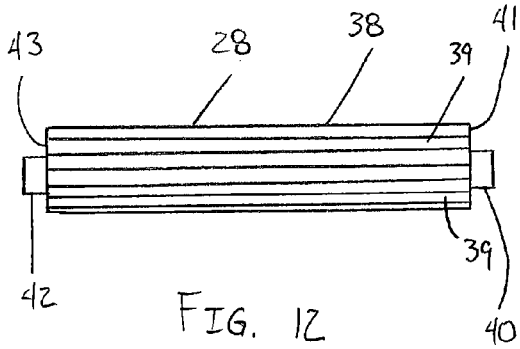
FIG. 12 is a front elevational view of a handle of FIG. 2.

Each of the first and second handles 28 and 29 is substantially identical. As shown in FIG. 12, the handle 28 has a substantially cylindrical member 38. A plurality of longitudinally extending ribs 39 extend outwardly from the cylindrical member 38 to facilitate a user's grip. A first protrusion 40 extends outwardly from a first end 41 of the cylindrical member 38. A second protrusion 42 extends outwardly from a second end 43 of the cylindrical member 38. The protrusions 40 and 42 extend through the openings 44 and 46 in the links 26 and 27 and the openings 37 in the vertical members 22-25. The first and second handles 28 and 29 are preferably rotatably disposed between the vertical members and the connecting links. Preferably, the handles 28 and 29 are made of a metal, such as, but not limited to, steel or aluminum.

Assembly and Operation

The handle assembly 21 includes four vertical members 22-25 pivotally connected to a hand-operated tool 11, such as a hydraulic, scissor-action cutting tool, as shown in FIGS. 2-8. The handle assembly 21 improves ergonomics and control for the hand-operated tool 11.

Each of the vertical members 22-25 is substantially identical. A first planar portion 31 is pivotally connected to the tool body 13. Pins 48 are inserted through openings 36 in the first planar portion 31 of the vertical members 22-25 to pivotally connect the vertical members to the tool body 13, although any suitable pivotal connection can be used.

The first handle 28 is inserted between the front vertical members 22 and 23. The first protrusion 40 on the first handle 28 is inserted through the first opening 37 in the third planar portion 33 of the first front vertical member 22. The second protrusion 42 is inserted through the first opening in the third planar portion of the second front vertical member 23. The angles 34 and 35 in the front vertical members 22 and 23 facilitate retaining the first handle 28 between the vertical members 22 and 23. Preferably, the angles 34 and 35 cause the vertical members 22 and 23 to exert a spring force on the first handle 28.

The second handle 29 is inserted between the rear vertical members 24 and 25. The first protrusion on the second handle 29 is inserted through the first opening in the third planar portion of the first rear vertical member 24. The second protrusion is inserted through the first opening in the third planar portion of the second rear vertical member 25. The angles 34 and 35 in the rear vertical members 24 and 25 facilitate retaining the second handle 29 between the vertical members 24 and 25. Preferably, the angles 34 and 35 cause the vertical members 24 and 25 to exert a spring force on the second handle 29.

The first connecting link 26 is connected between the first front and rear vertical members 22 and 24, as shown in FIGS. 2-7. The first front and rear vertical members 22 and 24 are flexed outwardly such that the first opening 44 at the first end 45 of the connecting link 26 receives the first protrusion 40 of the first handle 28 and the second opening 46 at the second end 47 of the connecting link receives the first protrusion of the second handle 29.

Figure 5:
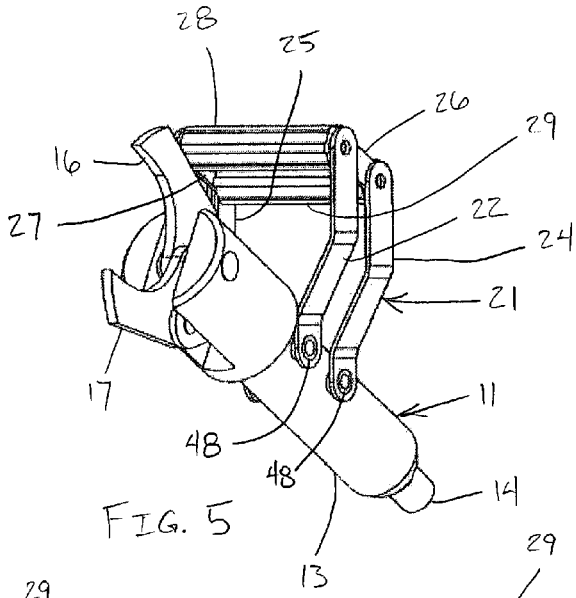
FIG. 5 is a perspective view of the tool and handle assembly of FIG. 3.

The second connecting link 27 is connected between the second front and rear vertical members 23 and 25, as shown in FIGS. 5 and 6. The second front and rear vertical members 23 and 25 are flexed outwardly such that the first opening at the first end of the connecting link 27 receives the second protrusion 42 of the first handle 28 and the second opening at the second end of the connecting link receives the second protrusion of the second handle 29.

Figure 2:
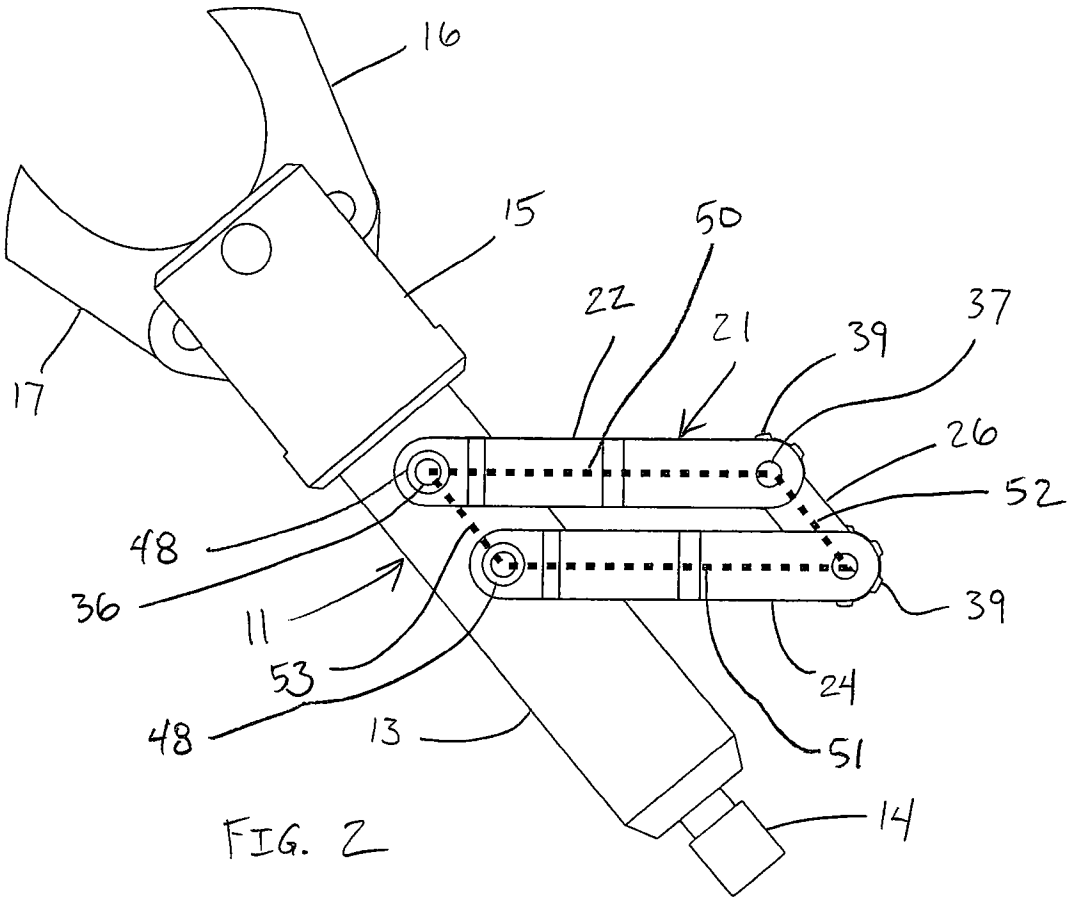
FIG. 2 is a side elevational view of the tool of FIG. 1 with a handle assembly in accordance with an exemplary embodiment of the present invention connected thereto and in a first position with respect to the tool.
Figure 3:
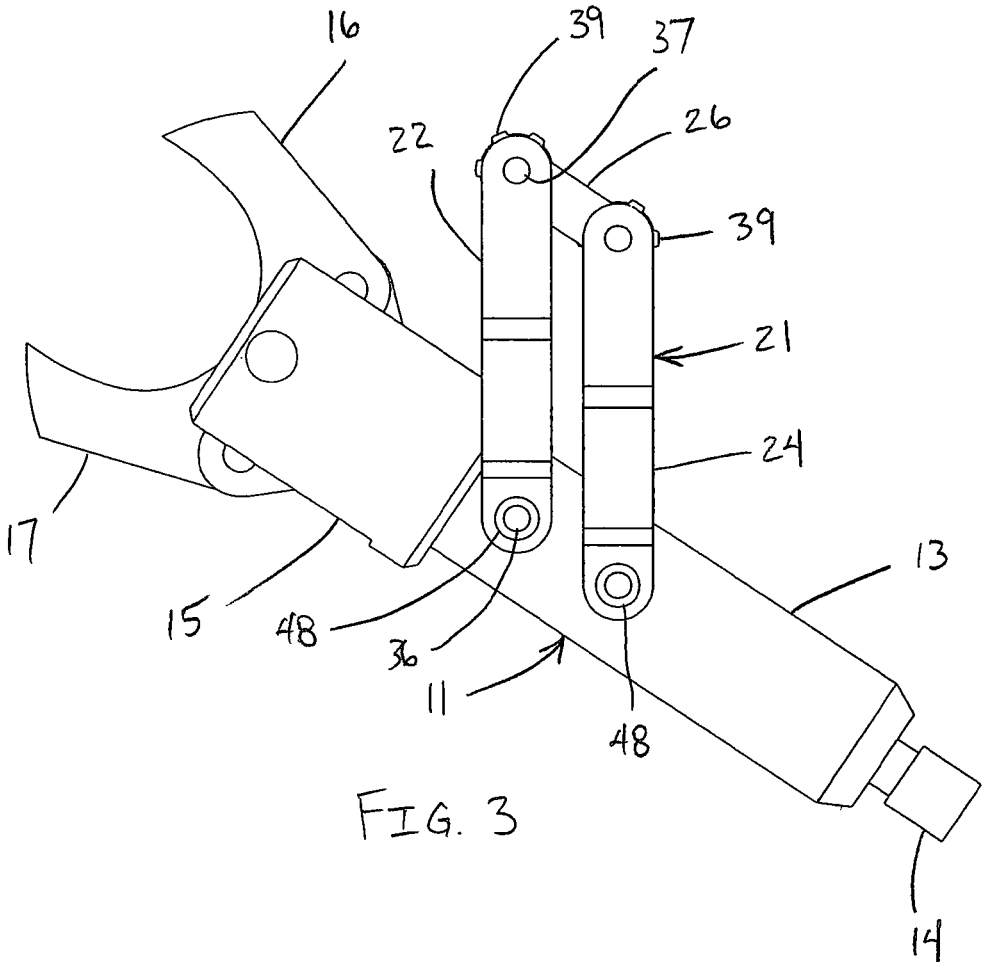
FIG. 3 is a side elevational view of the handle assembly of FIG. 2 in a second position with respect to the tool.
Figure 4:
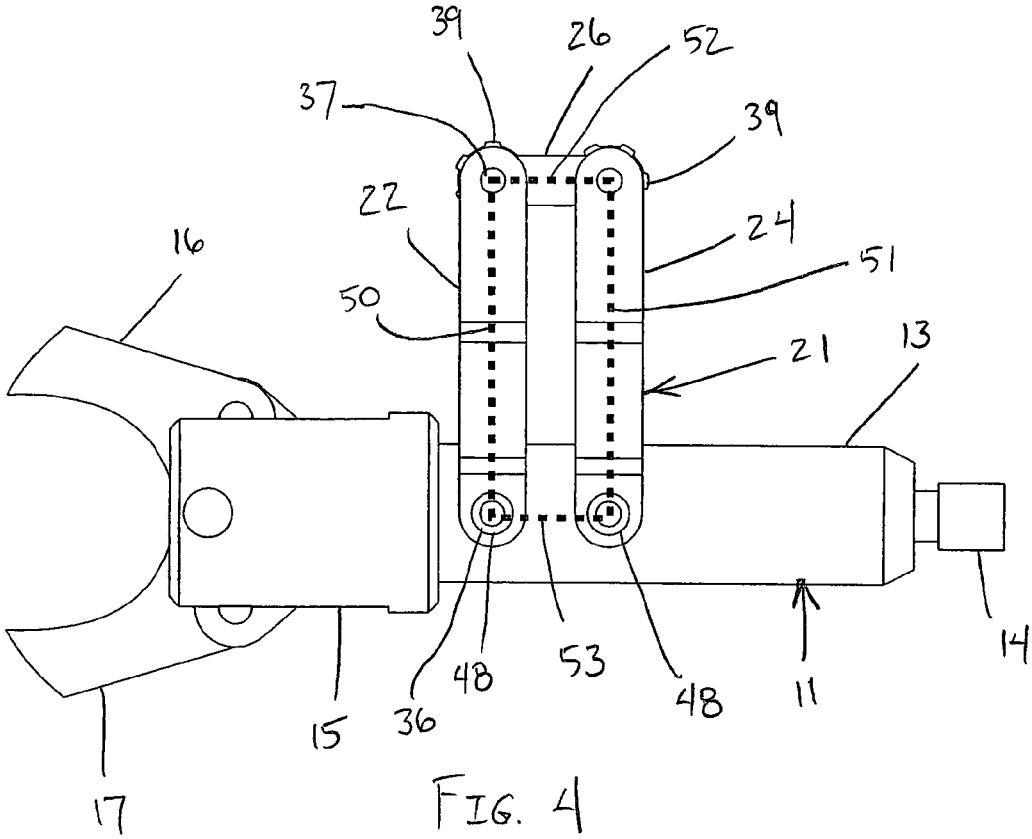
FIG. 4 is a side elevational view of the handle assembly of FIG. 2 in a third position with respect to the tool.

The first and second connecting links 26 and 27 allow the entire handle assembly 21 to move together. Accordingly, the tool 11 can be easily oriented by the user. The handle assembly 21 forms a "four-bar linkage" on each side of the tool body 13, as shown in FIGS. 2-4, as indicated by axes 50-53. Axes 50 and 51 of the first front and rear vertical members 22 and 24 are maintained substantially parallel during use. Axis 52 of the first connecting link 26 remains substantially parallel to an axis 53 of the tool body 13 during use. The first and second connecting links 26 and 27 are pivotally coupled to the first and As shown in FIGS. 2-7, the first and second handles 28 and 29 are preferably disposed such that the user can grip both the first and second handles with one hand. The plurality of ribs 39 on both the first and second handles 28 and 29 facilitate the user's grip on both handles 28 and 29. When the tool 11 is being used, the vertical members 22-25 remain substantially vertical as shown in FIGS. 2-4. The tool body 13 remains substantially parallel to the connecting links 26 and 27, such that the tool body 13 remains substantially parallel to a plane extending through the first and second handles 28 and 29. The vertical members 22-25 are each pivotally connected to the tool body 13, such that the tool body 13 is easily oriented with minimal effort by the user pivoting the user's hand in the direction of desired rotation of the tool 11. For example, pivoting the handles 28 and 29 rearwardly orients the tool body 13 downwardly, as shown in FIG. 2. The axes 50 and 51 of the first front and rear vertical members 22 and 24 remain substantially parallel. The axes 52 and 53 of the connecting link 26 and the tool body 13 remain substantially parallel. The easy orientation of the tool 11 is facilitated by the center of gravity of the tool body 13 being located on an axis between the connections of the front vertical members 22 and 23 to the tool body 13.

Pivoting the handles 28 and 29 forwardly orients the tool body 13 upwardly, as shown in FIG. 3. The axes 50 and 51 of the first front and rear vertical members 22 and 24 remain substantially parallel. The axes 52 and 53 of the connecting link 26 and the tool body 13 remain substantially parallel.

Pivoting the handles 28 and 29 such that both handles are in the same horizontal plane orients the tool body 13 to a substantially horizontal position, as shown in FIG. 4. The axes 50 and 51 of the first front and rear vertical members 22 and 24 remain substantially parallel. The axes 52 and 53 of the connecting link 26 and the tool body 13 remain substantially parallel.

Figure 8:
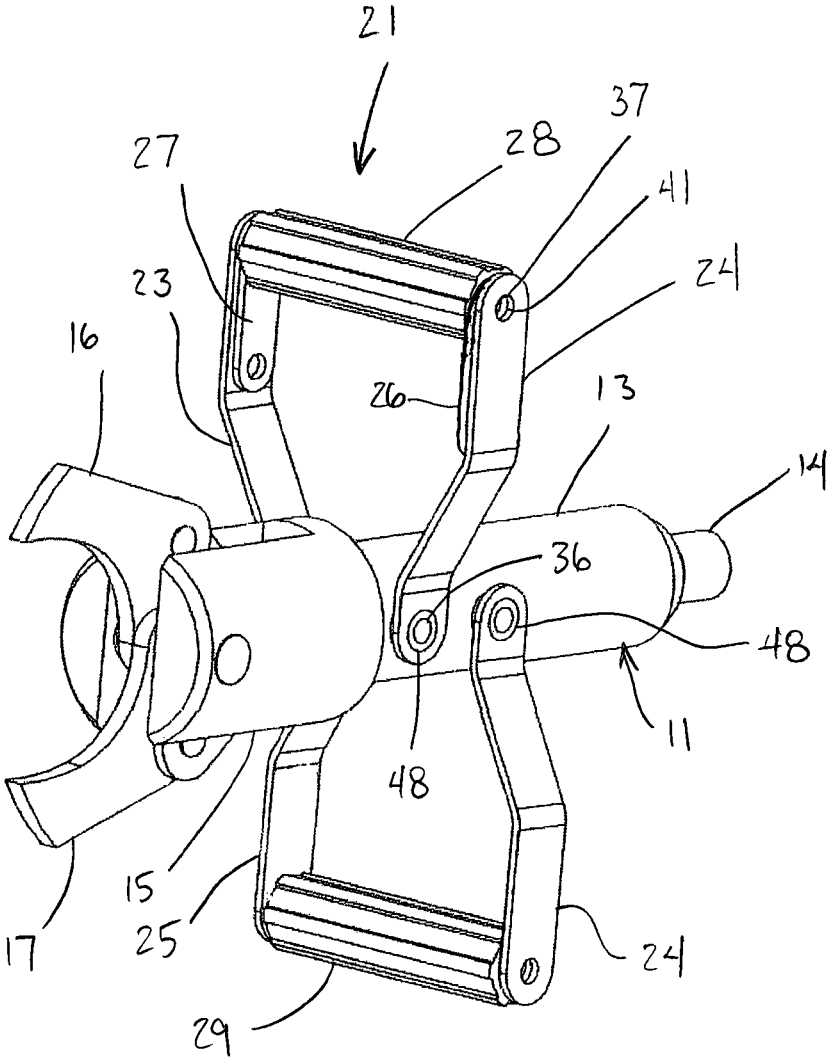
FIG. 8 is a perspective view of the handle assembly in which first and second handles are disposed on opposite sides of the tool.

The vertical members 22-25 can be flexed outwardly such that the connecting links 26 and 27 can be disconnected from the first and second rear vertical members 24 and 25 and the second handle 29, as shown in FIG. 8. Alternatively, the connecting links 26 and 27 can be disconnected from the first and second front vertical members 22 and 23 and the first handle 28. The first and second rear vertical members 24 and 25 can be rotated such that the second handle 29 is positioned on an opposite side of the tool body 13. The first and second front vertical members 22 and 23 extend in a first direction from the tool body and the first and second rear vertical members 24 and 25 extend in a second and opposite direction from the tool body 13. The second handle 29 can be disconnected from and reconnected to the first and second rear vertical members 24 and 25 if necessary to rotate the first and second rear vertical members 24 and 25 to an opposite side of the tool body 13. The connecting links 26 and 27 remain connected between the first and second front vertical members 22 and 23 and opposite ends of the first handle 28. The orientation of the handle assembly 21 shown in FIG. 28 allows the user to use two hands to operate the tool, thereby providing greater stability.

The foregoing embodiments and advantages are merely exemplary and are not to be construed as limiting the scope of the present invention. The description of an exemplary embodiment of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A handle assembly for a hand-operated tool, comprising:
first and second front vertical members pivotally connected to the tool;
first and second rear vertical members pivotally connected to the tool;
a first connecting link connecting said first front and rear vertical members;
a second connecting link connecting said second front and rear vertical members;
a first handle extending between said first and second front vertical members; and
a second handle extending between said first and second rear vertical members.

2. The handle assembly according to claim 1, wherein said first and second front and rear vertical members are substantially parallel.

3. The handle assembly according to claim 1, wherein said first and second connecting links are substantially parallel and have ends pivotally coupled to said first and second handles and said front and rear vertical members along first and second axes, respectively.

4. The base assembly according to claim 1, wherein said first and second front and rear vertical members extend in a similar direction from the tool.

5. The handle assembly according to claim 1, wherein a plurality of ribs extend longitudinally along an outer surface of said first and second handles.

6. The handle assembly according to claim 2, wherein said first and second front and rear vertical members remain substantially parallel when moved with respect to the tool.

7. The handle assembly according to claim 3, wherein said first and second handles remain substantially parallel when moved with respect to the tool.

8. The handle assembly according to claim 1, wherein said first and second connecting links are removably connected to said first front and rear vertical members and to said second front and rear vertical members, respectively.

9. The handle assembly according to claim 8, wherein said first connecting link is disconnectable from one of said first front and rear vertical members and said second connecting link is disconnectable from one of said second front and rear vertical members to move said first and second handles such that said first handle extends in a first direction from the tool and the second handle extends in a second direction from the tool.

10. The handle assembly according to claim 9, wherein said second direction is substantially opposite to said first direction.

11. A hand-operated tool, comprising:
a tool body;
a handle assembly connected to said tool body, said handle assembly including
first and second front vertical members pivotally connected to said tool body;
first and second rear vertical members pivotally connected to said tool body;
a first connecting link connecting said first front and rear vertical members;
a second connecting link connecting said second front and rear vertical members;
a first handle extending between said first and second front vertical members; and
a second handle extending between said first and second rear vertical members.

12. The hand-operated tool according to claim 11, wherein said tool body has a hydraulic connection to power said tool.

13. The hand-operated tool according to claim 10, wherein said first and second front and rear vertical members are substantially parallel and have ends pivotally coupled to said first and second handles and said front and rear vertical members along first and second axes, respectively.

14. The hand-operated tool according to claim 10, wherein said first and second connecting links are substantially parallel.

15. The hand-operated tool according to claim 14, wherein said first and second connecting links are substantially parallel to a longitudinal axis of said tool body.

16. The hand-operated tool according to claim 10, wherein said first and second handles remain substantially parallel when moved with respect to the tool.

17. The hand-operated tool according to claim 16, wherein an axis passing through said first and second vertical member pivotal connections passes through a center of gravity of said tool body.

18. The hand-operated tool according to claim 11, wherein said first and second connecting links are removably connected to said first front and rear vertical members and to said second front and rear vertical members, respectively.

19. The hand-operated tool according to claim 18, wherein said first connecting link is disconnectable from one of said first front and rear vertical members and said second connecting link is disconnectable from one of said second front and rear vertical members to move said first and second handles such that said first handle extends in a first direction from the tool and the second handle extends in a second direction from the tool.

20. The hand-operated tool according to claim 19, wherein said second direction is substantially opposite to said first direction.

* * * * *